US011220870B2

(12) United States Patent
Arora et al.

(10) Patent No.: US 11,220,870 B2
(45) Date of Patent: Jan. 11, 2022

(54) CABLE SYSTEM FOR DOWNHOLE USE AND METHOD OF PERFORATING A WELLBORE TUBULAR

(71) Applicant: SHELL OIL COMPANY, Houston, TX (US)

(72) Inventors: Dhruv Arora, Houston, TX (US); Matheus Norbertus Baaijens, Rijswijk (NL); Stephen Palmer Hirshblond, Houston, TX (US); Derrick Melanson, Houston, TX (US); Brian Kelly McCoy, Houston, TX (US)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 16/497,546

(22) PCT Filed: Mar. 22, 2018

(86) PCT No.: PCT/US2018/023788
§ 371 (c)(1),
(2) Date: Sep. 25, 2019

(87) PCT Pub. No.: WO2018/183084
PCT Pub. Date: Oct. 4, 2018

(65) Prior Publication Data

US 2020/0109606 A1 Apr. 9, 2020

Related U.S. Application Data

(60) Provisional application No. 62/477,264, filed on Mar. 27, 2017.

(51) Int. Cl.
*E21B 17/00* (2006.01)
*E21B 47/092* (2012.01)
*E21B 47/135* (2012.01)

(52) U.S. Cl.
CPC ..... *E21B 17/003* (2013.01); *E21B 47/092* (2020.05); *E21B 47/135* (2020.05)

(58) Field of Classification Search
CPC .... E21B 17/003; E21B 47/092; E21B 47/135; E21B 47/09; E21B 47/12; E21B 17/00;
(Continued)

(56) References Cited

U.S. PATENT DOCUMENTS 3,153,277 A 10/1964 Shore
4,858,688 A 8/1989 Edwards et al.
(Continued)

FOREIGN PATENT DOCUMENTS

WO 2016108875 A1 7/2016

OTHER PUBLICATIONS

International Search Report and Written Opinion received for PCT Patent Application No. PCT/US2018/023788, dated Jun. 28, 2018, 10 pages.

*Primary Examiner* — Tara Schimpf
(74) *Attorney, Agent, or Firm* — Shell Oil Company

(57) ABSTRACT

A metal wellbore tubular wall of a wellbore tubular, having a cable system arranged on an outside thereof, is to be perforated downhole. The cable system contains a fiber-optic cable, and a magnetic-permeability element with a relative magnetic permeability $\mu_{r,m}$ of at least 2,000, such as an electrical steel, is configured along a length of the fiber-optic cable. The cable system is located by sensing the magnetic-permeability element through the metal wellbore tubular wall, using a magetic orienting tool which is being lowered into the wellbore tubular. subsequently, the metal wellbore tubular wall is perforated in a direction away from the cable system.

18 Claims, 9 Drawing Sheets

(58) Field of Classification Search
CPC ..... E21B 17/10; E21B 17/20; G01D 5/353; G01V 3/26
See application file for complete search history.

(56) References Cited

U.S. PATENT DOCUMENTS

| | | | | |
|---|---|---|---|---|
| 4,938,299 | A | 7/1990 | Jelsma | |
| 5,095,981 | A | 3/1992 | Mikolajczyk | |
| 5,115,863 | A | 5/1992 | Olinger | |
| 5,247,990 | A | 9/1993 | Sudol et al. | |
| 5,575,333 | A | 11/1996 | Lirette et al. | |
| 6,006,830 | A | 12/1999 | Barron et al. | |
| 2001/0050172 | A1* | 12/2001 | Tolman | E21B 17/203 166/297 |
| 2012/0067580 | A1* | 3/2012 | Parsche | E21B 41/00 166/302 |
| 2015/0041117 | A1 | 2/2015 | Schlembach et al. | |
| 2016/0258271 | A1* | 9/2016 | McCoy | E21B 19/08 |
| 2016/0290835 | A1 | 10/2016 | McCoy | |
| 2017/0082766 | A1 | 3/2017 | Milne et al. | |
| 2017/0107795 | A1 | 4/2017 | Yeo et al. | |

* cited by examiner

CABLE SYSTEM FOR DOWNHOLE USE AND METHOD OF PERFORATING A WELLBORE TUBULAR

CROSS REFERENCE TO RELATED APPLICATIONS

This is a national stage application of International application No. PCT/US2018/023788, filed 22 Mar. 2018, which claims priority of U.S. Provisional Application No. 62/477264, filed 27 Mar. 2017.

FIELD OF THE INVENTION

The present invention is generally directed to a cable system for downhole use, and specifically to a magnetically detectable cable system. In one aspect, the invention is directed to a method of perforating a wellbore tubular provided with such a cable system.

BACKGROUND OF THE INVENTION

In the practice of operating oil and gas wells, it is not uncommon to deploy one or more cable systems alongside a casing. Such cable systems can include hydraulic cables, electrical cables, and/or fiber optic cables. Such cables may provide power and/or communication (p/c) capabilities between surface and downhole locations.

The use of, in particular, fiber optic (FO) sensors in downhole applications is increasing. In particular, optical fibers that can serve as distributed temperature sensors (DTS), distributed chemical sensors (DCS), or distributed acoustic sensors (DAS), and, if provided with Bragg gratings or the like, as discrete sensors capable of measuring various downhole parameters. In each case, light signals from a light source are transmitted into one end of the cable and are transmitted and through the cable. Signals that have passed through the cable are received at receiver and analyzed in microprocessor. The receiver may be at the same end of the cable as the light source, in which case the received signals have been reflected within the cable, or may be at the opposite end of the cable. In any case, the received signals contain information about the state of the cable along its length, which information can be processed to provide the afore-mentioned information about the environment in which the cable is located.

In cases where it is desired to obtain information about a borehole, an optical fiber must be positioned in the borehole. For example, it may be desirable to use DTS to assess the efficacy of individual perforations in the well. Because the optical fiber needs to be deployed along the length of the region of interest, which may be thousands of meters of borehole, it is practical to attach the cable to the outside of tubing that is placed in the hole. In many instances, the cable is attached to the outside of the casing, so that it is in close proximity within the borehole.

When a fiber optic cable system, or other type of cable system, is arranged on the outside of the casing, oriented perforating of casing may become important if the cable system is present at the level of the planned perforations. In some instances, a current practice for deployment of fiber optic sensor cables may entail the addition of one or more wire ropes that run parallel and adjacent to the fiber optic cable. Both the ropes and the cable may be secured to the outside of the tubing by clamps such as, for example clamps and protectors or with stainless steel bands and buckles and rigid centralizers. Such equipment is well known in the art and is available from, among others, Cannon Services Ltd. of Stafford, Tex. The wire ropes are preferably ferromagnetic (i.e. electromagnetically conductive), so that they can serve as markers for determining the azimuthal location of the optical fiber and subsequently orienting the perforating guns away from the fiber cable. These wire ropes may be on the order of 1 to 2 cm diameter so as to provide sufficient surface area and mass for the electromagnetic sensors to locate. Because of their size, the use of wire ropes can require costly "upsizing" of the wellbore in order to accommodate the added diameter. Besides necessitating a larger borehole, the wire ropes are susceptible to being pushed aside when run through tight spots or doglegs in the wellbore. Wire ropes that have been dislodged from their original position are less effective, both for locating the fiber optic cable and for protecting the optical cable from damage.

US-2015/0041117 and US-2016/0290835 disclose a system wherein an optical fiber is provided with two metal strips. The azimuthal location of the fiber optic cable system may be established from inside the casing by detecting magnetic flux signals. The strips can be detected by an electromagnetic metal detector from inside the well tubular to reveal the azimuthal location of the fiber optic cable. The metal strips can be made of an electrically conductive or ferromagnetic material such as steel, nickel, iron, cobalt, and alloys thereof.

However, such cable designs and installation configurations can require extensive mapping with a magnetic orienting tool (MOT), in order to achieve the required accuracy with respect to the location of the cable. The MOT, which is typically wireline run tool, may have to be stopped several times per joint of pipe for several pipe joints to locate the cable and build a cable location map with sufficient reliability.

Hence it is desirable to provide an improved system and method for magnetically determining the azimuthal position of a cable, for example a cable comprising an optical fiber, deployed on the outside of a tubular. Such improved system may need fewer measurement locations and/or determine the azimuth of the cable location with less uncertainty.

SUMMARY OF THE INVENTION

In one aspect, the present invention provides a cable system for downhole use, comprising cable and a magnetic-permeability element configured along a length of the cable, said magnetic-permeability element comprising a material having a relative magnetic permeability $\mu_r$ of at least 2,000.

In operation, the cable and the magnetic-permeability element are arranged on one side of a metal wall, whereby the cable and the magnetic-permeability element can be located using a magnetic orienting tool on the other side of the wall. The magnetic orienting tool senses the the magnetic-permeability element through the metal wall.

In another aspect, the invention provides a method of perforating a wellbore tubular provided with a cable system for downhole use, comprising:

providing a wellbore tubular downhole, wherein the cable system define above is arranged on an outside of said wellbore tubular;

lowering a magnetic orienting tool into the wellbore tubular;

locating the cable system through the wellbore tubular wall with the magnetic orienting tool;

subsequently perforating the metal wall of the wellbore tubular away from the cable system.

Unless otherwise specified, all materials-related parameters, including magnetic permeabilities, conductivity, resistivity, are defined at 20° C.

BRIEF DESCRIPTION OF THE DRAWINGS

The drawing figures depict one or more implementations in accord with the present teachings, by way of example only, not by way of limitation. In the figures, like reference numerals refer to the same or similar elements.

These figures are schematic and not to scale. Identical reference numbers used in different figures refer to similar components. Within the context of the present specification, cross sections are always assumed to be perpendicular to the longitudinal direction.

DETAILED DESCRIPTION OF THE INVENTION

Figure 1:
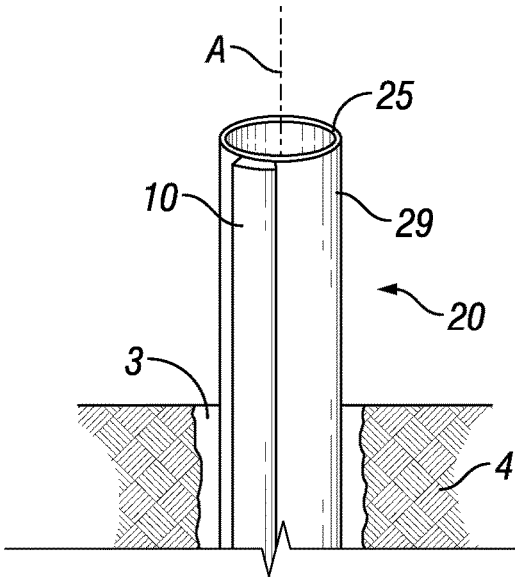
FIG. 1 shows a perspective view of a tubular element provided with a fiber optic cable system.

The person skilled in the art will readily understand that, while the detailed description of the invention will be illustrated making reference to one or more embodiments, each having specific combinations of features and measures, many of those features and measures can be equally or similarly applied independently in other embodiments or combinations.

The present description may make reference to hydraulic cable, electric cable, or fiber optic cable. For the purpose of interpretation hydraulic cable generally comprises at least one hydraulic line, an electrical cable generally comprises at least one electric line, and a fiber optic cable generally comprises at least one fiber optic line (typically an optical fiber).

Parts of the present disclosure are directed to a system for magnetic orienting across a metal wall of a device that is arranged on one side of the metal wall. The system may comprise:

a device adapted to be arranged on one side of the metal wall; and a magnetic-permeability element, provided at, near or connected to the device, comprising a material having a relative magnetic permeability ($\mu_r$) of at least 2000.

Specifically, the invention may relate to a magnetically detectable cable system, wherein the device may be a cable with the magnetic-permeability element configured along a length of said cable. Typically, a cable may comprise an elongate cable body defining a direction of length, and a functional line (such as a hydraulic, an electric, or an optical line) configured along the length of the elongate body. The magnetic-permeability element is configured and/or distributed along at an interval of the elongate body in the direction of length.

The relative magnetic permeability $\mu_r$ of the material of the magnetic-permeability element is preferably higher than that of the material of the metal wall. The relative magnetic permeability $\mu_r$ of the material of the magnetic-permeability element may suitably be at least 20 times higher than the relative magnetic permeability of the material of the metal wall. Herewith a significant contrast can be achieved between magnetic detectability of the magnetic-permeability element against the background magnetic permeability of the metallic wall, without needing excessive amounts of mass of the magnetic-permeability element.

Suitably, the material of the magnetic-permeability element may have an EM contrast ratio of at least 20/μΩ·cm, wherein EM contrast is defined as $\mu_r \cdot \sigma$ wherein $\sigma$ is the specific conductivity of the material. Generally, this corresponds to $\mu_r/\rho$ wherein $\rho$ is the resistivity of the material. Preferably, the material has an EM contrast ratio of at least 50/μΩ·cm.

The contrast between the magnetic detectability of the magnetic-permeability element and the metallic wall is also impacted by the masses of each of the magnetic-permeability element and the metallic wall that are probed in a certain sampling area. A target-to-background ratio of equivalent inductive mass (EIm) is preferably selected to exceed 5. More preferably, the target-to-background ratio is selected to exceed 15. The term "target-to-background ratio" as used herein means ratio of EIm of the magnetic-permeability element over the EIm of the metal wall in the same area that is covered by the magnetic-permeability element. EIm is defined as mass$\cdot\mu_r\cdot\sigma$.

The metal wall may be the wall of a wellbore tubular. The device may suitably comprise an optical fiber. The material may be selected from the group of: mu-metal, permalloy, and non-oriented electrical steel. The material may preferably have a relative magnetic permeability of at least 8,000, more preferably of at least 4,000, and even more preferably of at least 20,000. The material may have a resistivity of at least 30 μΩ·cm, or alternatively the material may have a resistivity of at least 37 μΩ·cm.

The magnetic-permeability element may be provided as a strip extending along at least part of the length of the device. Herein, the device may be, or comprise, an optical fiber. The strip may suitably be pasted to the device, such as the cable, or held in place by other means such as using for example adhesive tape. Suitably, the strip is sandwiched between the cable and the metal wall. In this way the magnetic-permeability element may be shielded by the cable from exposure to external mechanical impact, such as friction when running a wellbore tubular, on which the cable is arranged, into a wellbore.

According to another aspect, the disclosure provides the use of a system for providing information through a metal wall, the use comprising:

arranging a device on one side of the metal wall, arranging a magnetic-permeability element at, near or connected to the device, the magnetic-permeability element comprising a material as defined above.

The use may comprise a step of activating a magnetic orienting tool on an opposite side of the metal wall to locate the magnetic-permeability element on said one side of the metal wall. The use may comprise a step of optimizing the magnetic-permeability element using equivalent inductive mass (EIm). The use may comprise the step of optimizing the magnetic-permeability element, wherein the target-to-background ratio is selected to exceed 5. Preferably, the target-to-background ratio is selected to exceed 15.

The present disclosure may also provide a system and method for designing and constructing electromagnetic contrast in oil and gas wellbores for selective power transfer and communication across a metal wall. Communication herein may refer to locating a device though the metal wall for oriented perforating of the wall without damaging the device, or to other types of communication. Wall herein may refer to, for instance, the wall of a steel casing in a wellbore.

When selecting materials for downhole components, the primary considerations are typically: long term mechanical life, resistance to downhole environment and low cost. Material properties like magnetic susceptibility and electrical conductivity are typically ignored in conventional applications. Table 1 below lists relative magnetic permeability and resistivity of materials typically used in conventional oil-field applications:

TABLE 1

| Material | Rel. Magnetic Permeability $\mu_r$ (at 20° C.) | Resistivity $\rho$ ($\mu\Omega \cdot$ cm) (at 20° C.) | EM contrast $\mu_r/\rho$ $(\mu\Omega \cdot \text{cm})^{-1}$ |
|---|---|---|---|
| Low Carbon Steel | 100 | 16 | 6.25 |
| Austenitic Stainless Steel 316, 316L, 304 | 1.02 | 29.4 | 0.035 |
| Martensitic SS (410) annealed and hardened steel | 75 to 800 | 30 to 56 | 2.5 to 27 |

Relative magnetic permeability ($\mu_r$) of a specific material is the magnetic permeability of that material expressed in quantities of permeability of free space ($\mu_0$), wherein $\mu_0=4\pi\times10^{-7}$ N·A$^{-2}$. As such, the relative magnetic permeability is a dimensionless multiplication factor.

While inductively transferring power or communicating across these materials, the strength of the signal passing through the material depends on the ratio of the magnetic permeability and the resistivity. Traditionally, there has been no effort in downhole applications to alter material selection in order to create electromagnetic (EM) contrast using the ratio of relative magnetic permeability and resistivity ($\mu_r/\rho$) for which the units correspond to [$\rho^{-1}$]. The present disclosure uses $\mu\Omega^{-1}\cdot\text{cm}^{-1}$ and/$\mu\Omega\cdot$cm and ($\mu\Omega\cdot$cm) which all are interchangeable and mean the same.

The general notion in the field of oil and gas applications was that even if there would be any effect at all, the effect would be negligible with respect to the significant amounts of metal (typically steel) already in the wellbore, such as casing and tools. Herein, please note that for instance steel-reinforced fiber optic cable typically has a thickness and width in the order of 0.125"×0.5" (0.32 cm×1.27 cm), whereas a typical casing or liner (having steel grades such as C90, P110, or Q125) has a wall thickness in the order of 0.5" (1.27 cm) up to 1" (2.54 cm). I.e. the thickness of the cable and the metal reinforcement thereof is indeed relatively small with respect to the typical wall thickness of the tubing (for instance with a factor 1:4 up to 1:8 or more). Especially at increasing depths and pressures, the wall of the casing or liner will have to be thicker and stronger. Thus, in deeper wellbores and/or high pressure wellbores, the ratio between metal reinforcement of the cable and the casing wall thickness will typically increase even more.

It is challenging to accurately differentiate the signal from thin, for instance about 0.125 inch (3 mm) thick metal bars, from the baseline when the metal mass of the casing increases. The latter is typical, for instance, for larger diameter casings, high pressure wellbores, and/or for deep water applications with stringent safety requirements.

Table 2 shows the ratio of the metal mass in the reinforcement strips (target) and the casing mass (background) as a proxy of the signal to background ratio that can be detected accurately using a magnetic orienting tool, when the strips are made of typical steel (e.g. a material listed in Table 1).

TABLE 2

| | Thickness of metal strips | |
|---|---|---|
| | 0.5" (1.27 cm) | 0.75" (1.9 cm) |
| 5.5" casing ($\gamma$) | 0.33 | 0.49 |
| 7" casing ($\gamma$) | 0.25 | 0.38 |
| 5.5" casing ($\varepsilon$) | 1.30 | 1.95 |
| 7" casing ($\varepsilon$) | 1.00 | 1.50 |

Herein, $\gamma$ is the ratio of the mass of the metal bar (See for instance strip 11 in FIG. 2) versus the casing mass over the width of the bar. Table 2 includes values wherein both the casing and the metal bars are made of a typical steel for oil field applications, as exemplified in Table 1. Values for $\gamma$ below 0.4 are, in practice, too low to guarantee proper accuracy.

The detection of the added metal bars becomes even more challenging considering the fact that the wall thickness of typical casing can have up to about −12.5% tolerance and still be acceptable under API 5CT specifications. The same API specification also prescribes that casing shall have a certain weight per unit of length (typically expressed in pounds per foot). In combination with the set weight per unit of length, the tolerance limit implies that a portion of the wall of the casing—for instance referred to as thin wall side—may have up to 12.5% less material than another side—which may be referred to as heavy wall side. I.e., the thin wall side of the casing is lighter, i.e. comprises less metal mass, than the normal wall thickness side (which is heavier as a result). Therefore, if the metal bar of the optical cable lands on the thin wall side of the casing, its signal may be masked by the inherent acceptable anomaly in the casing wall thickness (according to API standards, such as 5CT). In other words, in a worst case scenario wherein the cable lands on the thin wall side, the signal of the cable may be of the same order or smaller than the background signal from the metal mass of the casing, in particular of the heavy wall side thereof, leading to false positives. The latter may result in the perforation of the cable.

The last two lines in Table 2 show the ratio of the maximum possible acceptable offset in casing mass to the mass of the metal bar. For instance, for a typical 7" (18 cm)

outer diameter casing, the mass of the 0.5" thick metal bar is about equal to the maximum possible error in the casing mass over the circumference of the tubular. Herein, E is the ratio of the mass of the metal bar versus the tolerance on the casing mass (over the width of the bar). Table 2 includes values for a situation wherein both the casing and the metal bars are made of a typical steel for oil field applications, as exemplified in Table 1. Herein, values of E in the range of 1.5 and lower indicate that tolerances in the casing wall thickness may lead to false positives in the orientation measurements.

Contrary to the general notion in the industry as outlined above, the applicant found that adding electro-magnetic contrast, for instance to the reinforced fiber optic cable, has a much stronger and more pronounced effect than expected. So much so, that the accuracy is improved significantly. Also, other applications, such as cross-steel-wall communication in oil and gas wellbores, are enabled due to the use of materials providing sufficient EM contrast. This effect is stronger, the results are more pronounced and the accuracy of detecting the azimuthal orientation via casing increases with increasing EM contrast.

By adding specialty alloys as listed in Table 3, such a radial contrast, herein also referred to as 'electromagnetic contrast', can be created. Table 3 below shows examples of materials suitable for applications according to the present disclosure, having electro-magnetic (EM) properties that can generate relatively high EM contrast:

TABLE 3

| Material | Rel. Magnetic Permeability $\mu_r$ | Resistivity $\rho$ ($\mu\Omega \cdot$ cm) (at 20° C.) | EM contrast ($\mu_r/\rho$) $(\mu\Omega \cdot \text{cm})^{-1}$ |
|---|---|---|---|
| Mu-Metal | 20,000 to 100,000, esp. 80,000 to 100,000 | 47 | 425 to 2125 |
| Permalloy | 8,000 | 30 | 267 |
| Non-oriented electrical steel | 8,000 to 16,000 | 37-50 | 160 to 432 |

Herein, magnetic tests are made on specimens specified by ASTM Method A 343. Data represent typical values.

The present disclosure proposes the use of a material providing an increased electro-magnetic contrast with respect to conventional wellbore materials for the applications outlined above. Herein, a lower threshold of the EM contrast ($\mu_r/\rho$) for the selected material may be selected at about 50/$\mu\Omega$·cm or in the order of about 100/$\mu\Omega$·cm. As the accuracy improves with increasing EM contrast, in a preferred embodiment a lower threshold for the EM contrast value is, for instance, about 150/$\mu\Omega$·cm to 200/$\mu\Omega$·cm. Relatively high EM contrast thus may refer to materials providing EM contrast exceeding the above referenced lower thresholds.

As an alternative threshold, the relative magnetic permeability can indicate suitability for use in accordance with a system or method of the present disclosure. Herein, suitable material for the present disclosure may have a relative magnetic permeability ($\mu_r$) of at least 2,000. Preferably, the relative magnetic permeability ($\mu_r$) is at least 4,000. More preferably, suitable materials for the present disclosure may have a relative magnetic permeability ($\mu_r$) of at least 8,000.

In SI units, magnetic permeability is measured in Henries per meter (H/m or $H \cdot m^{-1}$), or equivalently in newtons per ampere squared ($N \cdot A^{-2}$). The permeability constant ($\mu_0$), also known as the magnetic constant or the permeability of free space, is a measure of the amount of resistance encountered when forming a magnetic field in a classical vacuum. The magnetic constant has the exact (defined) value ($\mu_0 = 4\pi \times 10^{-7}\ H \cdot m^{-1} \approx 1.2566370614 \times 10^{-6}\ H \cdot m^{-1}$ or $N \cdot A^{-2}$). Relative permeability ($\mu_r$), is the ratio of the permeability $\mu$ of a specific medium (such as the materials listed in Tables 1 and 2) to the permeability of free space $\mu_0$: $\mu_r = \mu/\mu_0$.

In addition, the material properties of the materials exemplified in Table 3 can be used to describe suitable materials. For instance:

Mu-metal is a nickel-iron soft magnetic alloy with very high permeability. It has several compositions. Nickel content may, for instance, be in the range of 70 to 85%. One such composition is approximately 77% nickel, 16% iron, 5% copper and 2% chromium or molybdenum. More recently, mu-metal is considered to be ASTM A753 Alloy 4 and is composed of approximately 80% nickel, 5% molybdenum, small amounts of various other elements such as silicon, and the remaining 12 to 15% iron. A number of different proprietary formulations of the alloy are sold under trade names such as MuMETAL, Mumetal1, and Mumetal2.

Amumetal™ is another option, comparable to mu-metal. Amumetal as manufactured by company Amuneal is a nickel-iron alloy with high Nickel content—for instance about 80%—and relatively moderate molybdenum content—for instance about 4.5%—and iron. This alloy conforms with international specifications prescribed in ASTM A753, DIN 17405, IEC 404, and JIS C2531.

Permalloy is a nickel-iron magnetic alloy. Invented in 1914 by physicist Gustav Elmen at Bell Telephone Laboratories, it is notable for its very high magnetic permeability, having relative permeability of up to around 100,000. Permalloy may comprise in the range of about 40 to 85% nickel. Other compositions of permalloy are available, designated by a numerical prefix denoting the percentage of nickel in the alloy. For example "45 permalloy" means an alloy containing 45% nickel, and 55% iron. "Molybdenum permalloy" is an alloy of 81% nickel, 17% iron and 2% molybdenum (invented at Bell Labs in 1940). Supermalloy, at 79% Ni, 16% Fe, and 5% Mo, is also well known for its high performance as a "soft" magnetic material, characterized by high permeability and low coercivity.

Electrical steel (lamination steel, silicon electrical steel, silicon steel, relay steel, transformer steel) is a special steel tailored to produce specific magnetic properties: small hysteresis area resulting in low power loss per cycle, low core loss, and high permeability. Electrical steel is an iron alloy which may have from zero to 6.5% silicon (Si:5Fe). Commercial alloys usually have silicon content up to 3.2%. Manganese and aluminum can be added up to 0.5%. Herein, contents may be expressed in volume percent. Silicon significantly increases the electrical resistivity of the steel, which decreases the induced eddy currents and narrows the hysteresis loop of the material, thus lowering the core loss. The concentration levels of carbon, sulfur, oxygen and nitrogen are typically kept low, as these elements may indicate the presence of carbides, sulfides, oxides and nitrides. The carbon level is typically kept to 0.005% or lower.

Sendust is a magnetic metal powder that was invented by Hakaru Masumoto at Tohoku Imperial University in Sendai, Japan, about 1936 as an alternative to permalloy in inductor applications for telephone networks. Sendust composition is typically 85% iron, 9% silicon and 6% aluminum. The powder is sintered into cores to manufacture inductors. Sendust cores have high magnetic permeability (up to 140,000), low loss, low coercivity (5 A/m) good temperature stability and saturation flux density up to 1 T.

Supermalloy is an alloy composed of nickel (75%), iron (20%), and molybdenum (5%). It is a magnetically soft material. The resistivity of the alloy is 0.6 $\Omega \cdot mm^2/m$ (or $6.0 \times 10^{-7} \Omega \cdot m$). It has an extremely high magnetic permeability (approximately 800000 $N/A^2$) and a low coercivity.

Other materials with suitable magnetic properties, having similar magnetic properties to mu-metal, include Co-Netic, supermumetal, nilomag, sanbold, molybdenum permalloy, M-1040, Hipernom, and HyMu-80.

The materials according to the present disclosure can be used to improve conventional structures for any of the downhole applications exemplified above. For instance, one of the methods of permanently deploying optical fiber in a wellbore includes banding and/or clamping an assembly of a specialty fiber optic cable (e.g. Tubing Encapsulated Fiber (TEF), and polymer coated TEF) and one or two ½" (1.27 cm) diameter wire ropes on the casing as it is run in the hole and cementing the assembly in place. Herein, one or more or the wire ropes would comprise, or be made entirely of, material providing increased EM contrast according to the present disclosure. Thus, the cable would be locatable with the magnetic locating tool to allow oriented perforating of the casing without damaging the cable.

In an improved embodiment, a Low Profile Cable (LPC) simplifies this method of permanent deployment by encapsulating the fiber-optic cable and cable protection into one flat cable. The ½" (1.27 cm) diameter wire ropes are replaced with thinner steel bars (⅛" (3 mm)) that provide better crush resistance. The overall thickness of the encapsulated cable (profile) may be about half of the Wire-rope-TEF deployment assembly and therefore a larger wellbore size is not needed. Descriptions of LPC are provided in US2016/0290835 and US2015/0041117, which disclosures are both incorporated herein by reference.

FIG. 1 shows a perspective view of a fiber optic cable system 10 mounted on a tubular element 20. The tubular element comprises a cylindrical wall 25 extending about a central axis A, which is parallel to a longitudinal direction. The cylindrical wall 25, seen in cross section, has a circular circumference having a convex outward directed wall surface 29. The fiber optic cable system 10 is a fully encapsulated fiber optic cable that extends in the longitudinal direction.

The tubular element 20 may be deployed inside a borehole 3 drilled in an earth formation 5. The tubular element 20 may be (part of) any kind of well tubular, including for example but not limited to: casing, production tubing, lining, cladding, coiled tubing, or the like. The tubular element 20 may be any tubular or other structure that is intended to remain in the borehole 3 at during the duration of use of the fiber optic cable system 10 as FO sensor. The tubular element 20, together with the fiber optic cable system 10, may be cemented in place.

Figure 2:
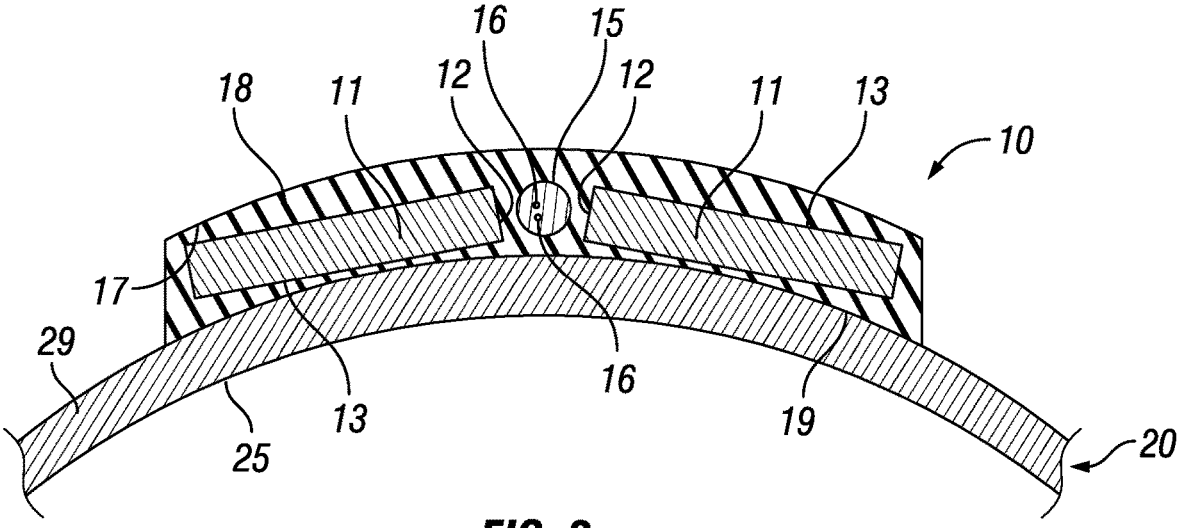
FIG. 2 shows a cross sectional view of the tubular element of FIG. 1 and an embodiment of a fiber optic cable system according to the present disclosure.
Figure 3:
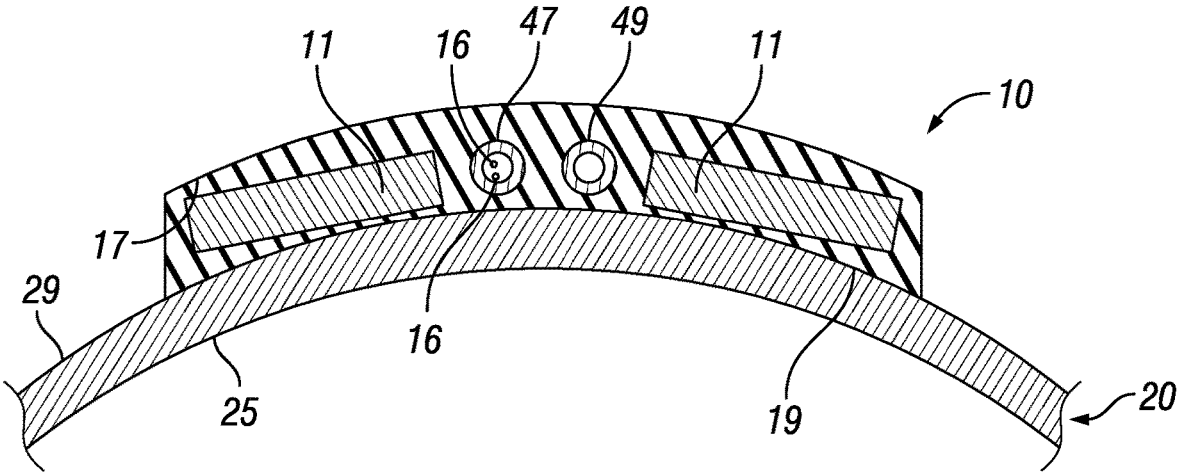
FIG. 3 shows a cross sectional view of a section of the tubular element of FIG. 1 and another embodiment of a fiber optic cable system.

Two examples of the fiber optic cable system 10 are illustrated in FIGS. 2 and 3. These figures provide cross sectional views on a plane that is perpendicular to the longitudinal direction.

Starting with FIG. 2, the fiber optic cable system 10 comprises (for instance) two elongate metal strips 11 and (at least) one fiber optic cable 15 disposed between the elongate metal strips 11. The fiber optic cable 15 and the elongate metal strips 11 all extend parallel to each other in the longitudinal direction (perpendicular to the plane of view). The elongate metal strips 11 and the fiber optic cable are together encapsulated in an encapsulation 18, thereby forming an encapsulated fiber optic cable extending in the longitudinal direction. In the embodiment of FIG. 2, the fiber optic cable 15 and the elongate metal strips 11 are fully surrounded by the encapsulation 18.

FIG. 3 shows an alternative group of embodiments, wherein the encapsulated fiber optic cable comprises a first length of hydraulic tubing 47 that is provided within the encapsulation. The first length of hydraulic tubing 47 extends along the longitudinal direction. The optical fiber(s) 16 may be disposed within the first length of hydraulic tubing 47.

According to a conceived method of producing the fiber optic cable system according to the alternative group of embodiments illustrated in FIG. 3, the encapsulation having at least the first length of hydraulic tubing 47 and the elongate metal strips 11 in it may first be produced and delivered as an intermediate product without any optical fibers. This intermediate product may subsequently be completed by inserting the optical fiber(s) 16 into the first length of hydraulic tubing 47. This may be done after mounting the intermediate product on the tubular element 20 and/or after inserting the intermediate product into the borehole 3 (with or without mounting on any tubular element).

One suitable way of inserting the optical fiber(s) 16 into the first length of hydraulic tubing 47 is by pumping one or more of the optical fiber(s) 16 through the first length of hydraulic tubing 47.

Suitably, the first length of hydraulic tubing 47 may be a hydraulic capillary line, suitably formed out of a hydraulic capillary tube. Such hydraulic capillary tubes are sufficiently pressure resistant to contain a hydraulic fluid. Such hydraulic capillary tubes are known to be used as hydraulic control lines for a variety of purposes when deployed on a well tubular in a borehole. They can, for instance, be used to transmit hydraulic power to open and/or close valves or sleeves or to operate specific down-hole devices. They may also be employed to monitor downhole pressures, in which case they may be referred to as capillary pressure sensor. Such hydraulic capillary tube is particularly suited in case the optical fiber(s) 16 are pumped through the hydraulic tubing.

Preferred embodiments comprise a second length of hydraulic tubing 49 within the encapsulation, in addition to the first length of hydraulic tubing 47. The material from which the second length of hydraulic tubing 49 is made, and/or the specifications for the second length of hydraulic tubing 49, may be identical to that of the first length of hydraulic tubing 47. The second length of hydraulic tubing 49 suitably extends parallel to the first length of hydraulic tubing 47.

Figure 4:
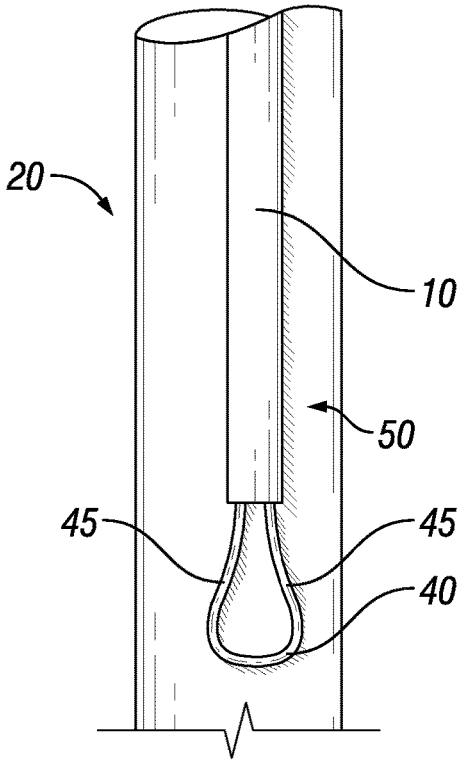
FIG. 4 shows a side view of a fiber optic cable system mounted on the tubular element.

Suitably, as schematically illustrated in FIG. 4, the fiber optic cable system 10 having first and second lengths of hydraulic tubing may further comprise a hydraulic tubing U-turn piece 40. The hydraulic tubing U-turn piece 40 is suitably configured at a distal end 50 of the encapsulated fiber optic cable 10, and it may function to create a pressure containing fluid connection between the first length of hydraulic tubing 47 and the second length of hydraulic tubing 49. When the fiber optic cable system 10 is inserted into a borehole, as schematically depicted in FIG. 1, the distal end 50 of the fiber optic cable system 10 suitably is the end that is inside the borehole 3 and furthest away from the surface of the earth in which the borehole 3 has been drilled.

Suitably, connectors 45 are configured between the first length of hydraulic tubing 47 and the second length of hydraulic tubing 49 and respective ends of the hydraulic tubing U-turn piece 40. One way in which the hydraulic tubing U-turn piece 40 can be used is provide a continuous hydraulic circuit having a pressure fluid inlet and return line outlet at a single end of the fiber optic cable system 10. This single end may be referred to as proximal end. The preferred embodiments facilitate pumping optical fiber(s) 16 down hole from the surface of the earth, even if the well has already been completed and perforated.

More than two lengths of hydraulic tubing within a single encapsulation has also been contemplated.

The following part of the disclosure concerns subject matter that may apply to both the group of embodiments that is represented by FIG. 2, and the other group of embodiments that is represented by FIG. 3. Reference numbers have been employed in both figures.

The material from which the encapsulation 18 is made is suitably a thermoplastic material. Preferably the material is an erosion-resistant thermoplastic material.

Seen in said cross section, the encapsulation 18 has outer contour 17 and inside contour 19. Preferably, it is a circular concave inside contour 19 section and a circular convex outside contour section 17, to match the wall 25 of the tubular 20. Herein the one or more elongate metal strips 11 and the at least one fiber optic cable 15 are positioned between the circular concave inside contour section 19 and the circular convex outside contour section 17. When mounted on the tubular element 20, the circular concave inside contour section 19 suitably has a radius of curvature that conforms to the convex outward directed wall surface 29 of the tubular element 20.

The fiber optic cable 15 typically comprises one or more optical fibers 16, which can be employed as sensing fibers. The optical fibers 16 may extend straight in the longitudinal direction, or be arranged in a non-straight configuration such as a helically wound configuration around a longitudinally extending core. Combinations of these configurations are contemplated, wherein one or more optical fibers 16 are configured straight and one or more optical fibers are configured non-straight.

The elongate metal strips 11 may each be made out of solid metal. Both may have a rectangular cross section. Other four-sided shapes have been contemplated as well, including parallelograms and trapeziums. Suitably the four-sided cross sections comprise two short sides 12 and two long sides 13, whereby the metal strips are configured within the encapsulation with one short side 12 of one of the metal strips facing toward one short side 12 of the other of the metal strips, whereby the fiber optic cable 15 is between these respective short sides.

The strips 11 suitably comprise a material according to the present disclosure, providing increased EM contrast, as described above. Alternatively, the strips 11 may be made out of solid high-EM contrast material. The strips may for instance be extruded or roll formed. Suitably, for borehole applications the short sides measure less than 6.5 mm, preferably less than 4 mm, but more than 2 mm. The long sides are preferably more than 4× longer than the short sides. Suitably, the long sides are not more than 7× longer than the short sides, this in the interest of the encapsulation. The diameter of the FO cable may be between 2 mm and 6.5 mm, or preferably between 2 mm and 4 mm.

Figure 5:
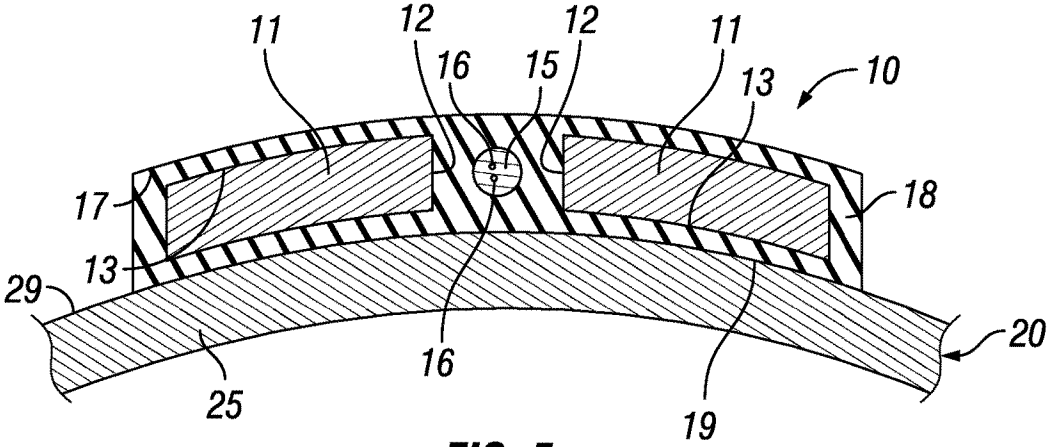
FIG. 5 shows a cross sectional view of the tubular element of FIG. 1 and an embodiment of a fiber optic cable system.

Sides of the four-sided shape can be, but are not necessarily, straight. For instance, one or more of the sides may be curved. For instance, it is contemplated that one or both of the long sides are shaped according to circular contours. An example is illustrated in FIG. 5. The circular contours may be mutually concentric, and, if the fiber optic cable system is mounted on a tubular element, the circular contours may be concentric with the contour of the outward directed wall surface 29. If the encapsulation 18 comprises a circular concave inside contour 19 section and/or a circular convex outside contour section 17, circular contours of the elongate metal strips may be concentric with the circular concave inside contour 19 section and/or the circular convex outside contour section 17. Embodiments that employ metal strips 11 with non-straight sides may in all other aspects be identical to other embodiments described herein.

The fiber optic cable system comprising the encapsulated fiber optic cable is suitably spoolable around a spool drum. This facilitates deployment at a well site, for instance. The metal strips 11 can be taken advantage of when perforating the tubular element 20 on which the fiber optic cable system is mounted, as the azimuth of the fiber optic cable system may be established from inside of the tubular element by detecting magnetic flux signals inside the tubular element. Perforating guns and magnetic orienting devices are commercially available in the market. A magnetic orienting device is disclosed in, for instance, U.S. Pat. No. 3,153,277.

In an alternative embodiment, it is possible to laminate high electromagnetic contrast metal alloys, for instance on each other, or onto other materials. Laminates may for instance improve signal strength, allow more efficient utilization of available space, and/or allow to minimize required volumes of the material and associated costs. This is possible due to lower propagating skin depths for commonly used transmitting frequencies in the high EM contrast materials. Exemplary embodiments are described below.

Figure 6:
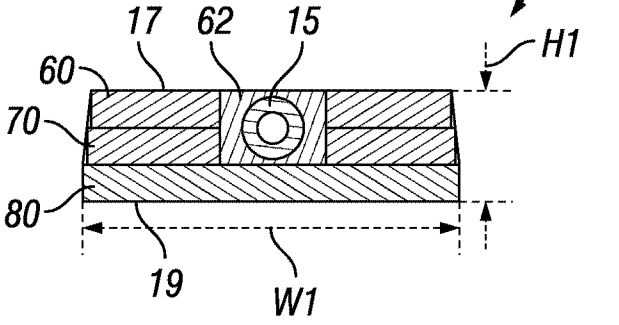
FIGS. 6 to 14 show a cross sectional views of respective embodiments of a fiber optic cable system according to the present disclosure.

FIG. 6 shows a fiber optic cable system 10 provided with at least one fiber optic cable 15. The system may comprise a number of layers. A top layer 60 may be a protective and/or shielding layer. The top layer for instance comprises electrical tape, i.e. electrically conductive tape. A second layer 70 may comprise a high EM contrast material according to the disclosure. The second layer may comprise a layer of solid high EM contrast material. Alternatively, the second layer 70 may comprise a laminate of two or more, for instance about four to six, sheets of high EM contrast material laminated onto each other. A third or lower layer 80 may comprise a bonding and/or carrier material. The carrier material may comprise a suitable plastic. The plastic may be thermoplastic polymer, for instance ABS (Acrylonitrile butadiene styrene) plastic. Alternatively, the plastic layer 80 may comprise EPDM (ethylene propylene diene monomer (M-class) rubber). A filler material 62 may be arranged covering the fiber optic cable and filling any voids between the fiber optic cable and one of more of the layers 60, 70, 80. The filler material may comprise thermoplastic filler. The cable 10 has a height H1 and a width W1.

Figure 7:
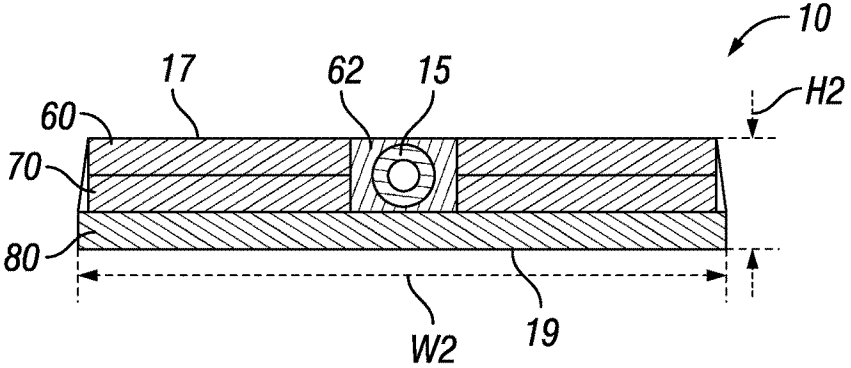

FIG. 7 basically shows a fiber optic cable system 10 similar to the cable 10 of FIG. 6, but having a different height H2 and/or width W2. The mass of the high EM contrast material layer 70 can be varied by making said layer 70 thicker or thinner, or by making said layer wider or smaller. Thus, the mass of the high EM contrast material and the contrast provided can be adapted and optimized depending on the background. The background herein may indicate signals originating from the tubular wall, e.g. the casing wall, whereon the cable 10 will be applied.

Figure 8:
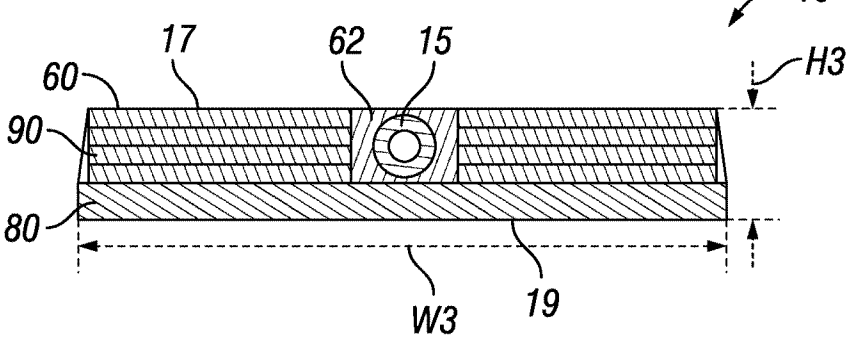
Figure 9:
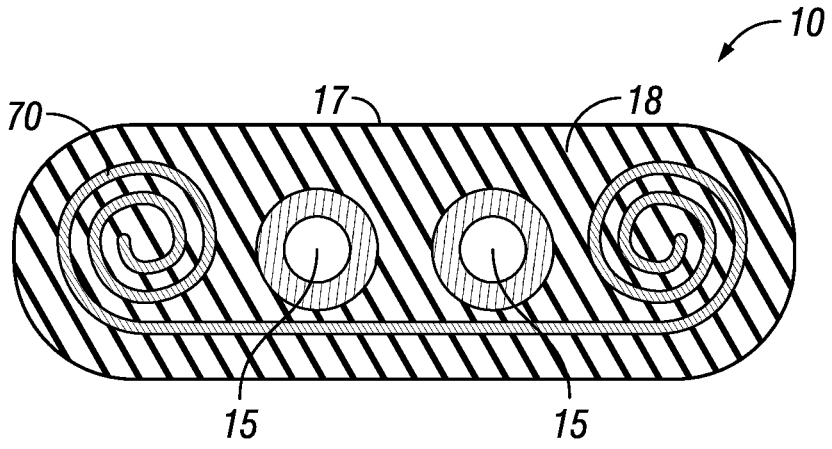
Figure 10:
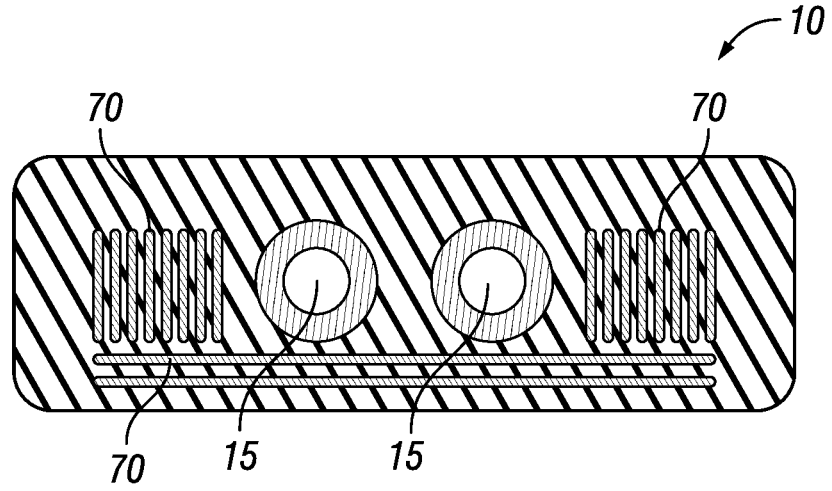
Figure 11:
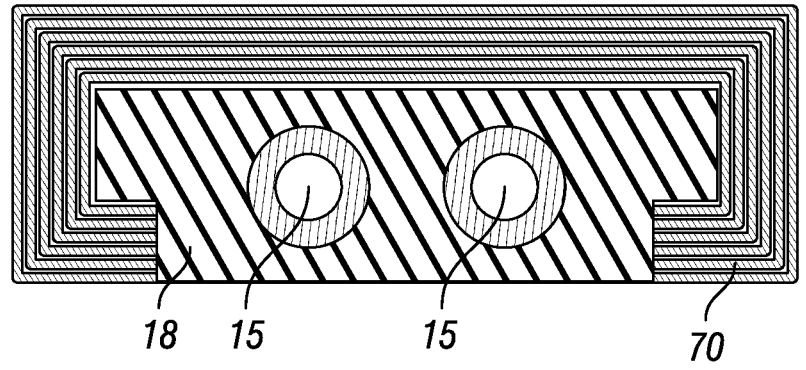
Figure 12:
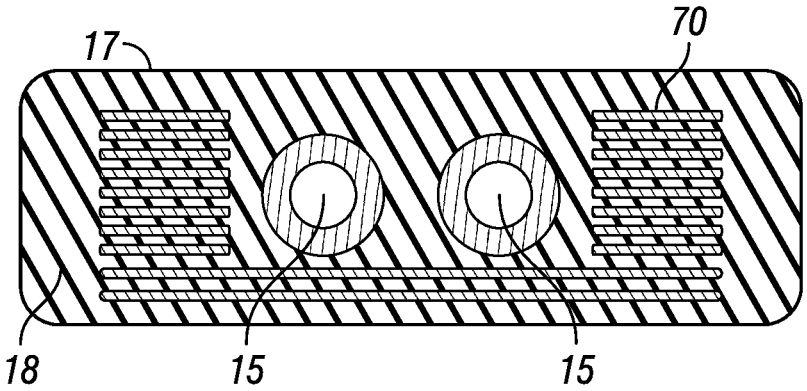
Figure 13:
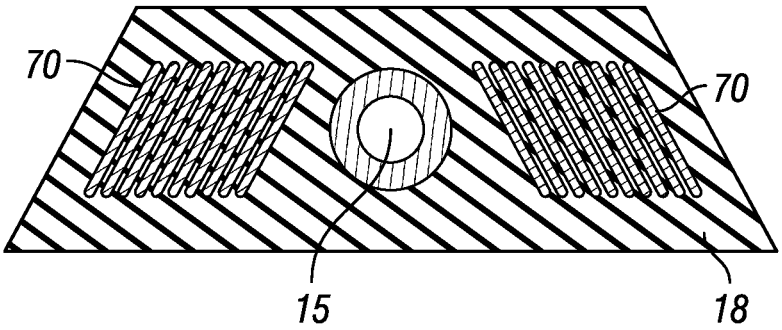
Figure 14:
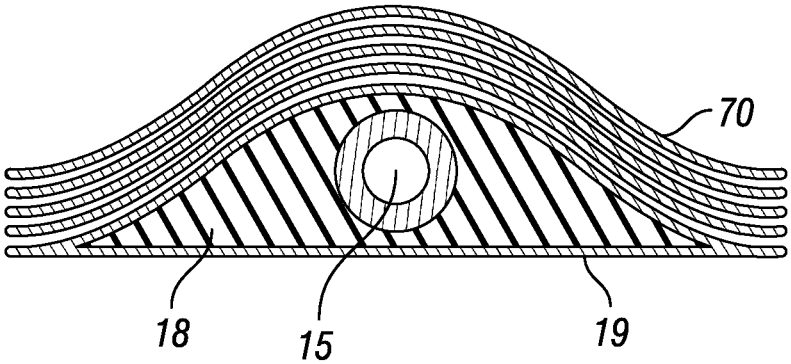

FIG. 8 shows a fiber optic cable system 10 similar to the cable 10 of FIG. 6, but having a second layer 90 comprised of electrical steel. The electrical steel layer 90 is relatively cost effective. The layer 90 itself may be a laminate, comprising a number of electrical steel strip layers or, for instance about 5 to 20 strip layers or laminae. The cable 10 of FIG. 8 may have a suitable height H3 and width W3. The mass of the high EM contrast material layer 90 can be varied by making said layer 90 thicker or thinner, wider or smaller, or by changing the number of strips. Thus, the mass of the high EM contrast material and the contrast provided can be adapted and optimized depending on the expected background signal.

In a practical embodiment, suitable for application on typical wellbore tubular, the layer 70 may have a width in the order of 0.2 to 1 inch (5 mm to 2.54 cm). For a 5" to 7" casing, the width may be in the range of, for instance, about 0.25 to 0.5 inch (6 mm to 1.3 cm). The layer 70 may have a thickness in the order of 0.03 to 0.3 inch (0.8 to 8 mm). For application on a 5" to 7" casing, the thickness may be in the range of, for instance, about 0.05 to 0.1 inch (1.3 to 2.5 mm). For application on a 5" to 7" casing, the total thickness H1/H2 of the cable 10 may be in the range of, for instance, about 0.15 to 0.25 inch (3.5 to 6 mm). The total width W1/W2 of the cable 10 may be in the order of about 0.3 to 2 inch (7.5 mm to 5.5 cm). For application on a 5" to 7" casing, the total width W1/W2 of the cable 10 may be in the range of, for instance, about 0.5 to 1.25 inch (12.5 to 32 mm).

In a practical embodiment, the cable 10 of FIG. 8 may have similar sizes, i.e. W3 and H3 may be in a similar range as indicated with respect to the sizes H1/H2 and W1/W2. Difference is the number of laminae included in the high EM contrast layers. Layer 90 may comprise a larger number of thinner electrical steel laminae, compared to layer 70.

FIGS. 9 to 14 shows a few alternative cable geometries provided with at least one high EM contrast layer 70. Herein, high EM contrast layer 70 may comprise any of the high EM contrast materials according to the present disclosure, including any of the materials listed in Table 3 or listed above.

There are several different kinds of flat pack cables or assemblies available to carry instrumentation and/or power in sub-surface wells. For instance ESP (electrical submersible pump) cables, Thermo-couple packs, Flatpack by Halliburton, Permanent downhole cable and Neon Cable by Schlumberger, Standard TEC™, Pressure TEC™, Digi TEC™, Flat TEC™, and PermflowR by Perma-Tec, Flat-Pak™ by CJS, commodity cable or low profile cable (see FIGS. 3 and 5) by Shell, conventional Wire-rope FIMT (fiber in metal tube) assembly, etc. EM contrast can be built into these cables by:

- (at least partly) replacing metals or adding metals with high EM contrast in various orientations, shapes, lamination, etc.;
- Creating EM contrast in the current design by adding laminations (fully or partially insulated) or altering the manufacturing process of current materials to increase magnetic susceptibility;
- Altering the metallurgy of the (Tubing encapsulated conductor) TEC/(Tubing encapsulated fiber) TEF or using a fiber in plastic tube or upbuffering of bare fiber; and
- Creating direct contact of high EM contrast material with the tubular metal.

Existing EM detection tools typically cannot locate or detect small variations in existing oil field materials when placed in between or on the outside of several tubulars, implying the target is severely masked by the background signal originating from the metal mass of the tubulars.

Figure 15:
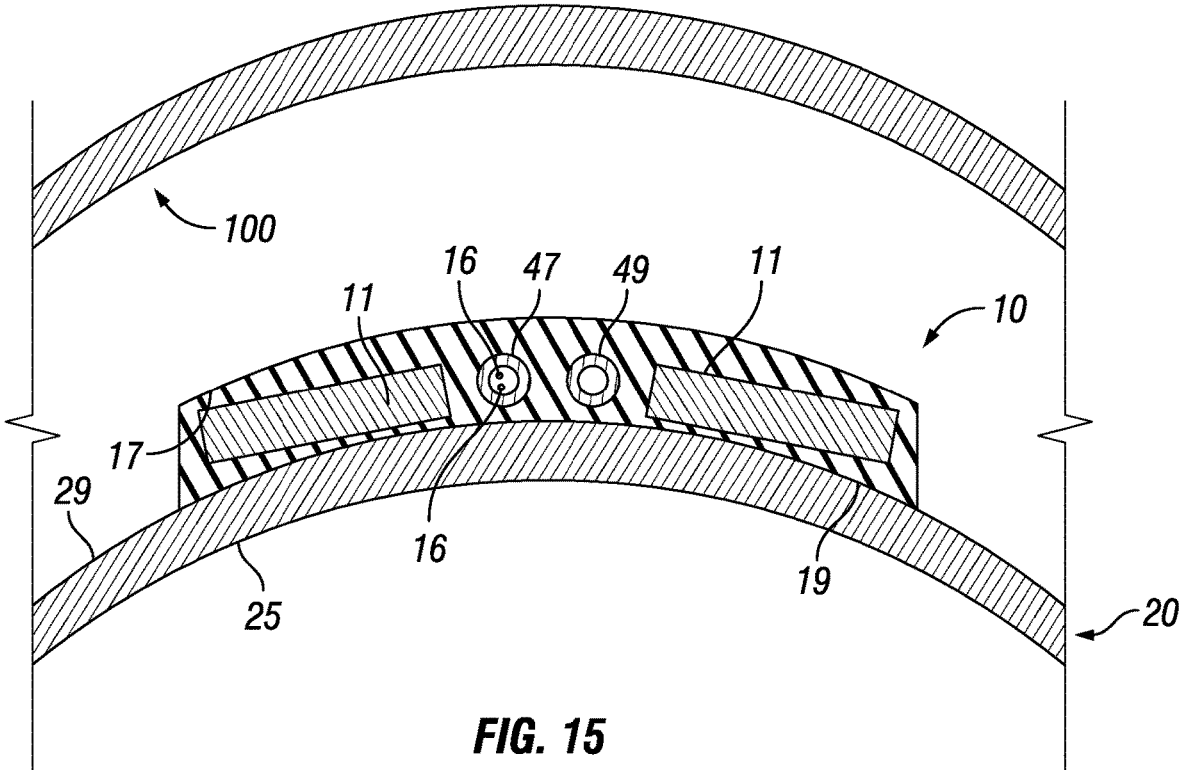
FIG. 15 shows a cross sectional view of an embodiment of a fiber optic cable system placed in between multiple tubulars.
Figure 16:
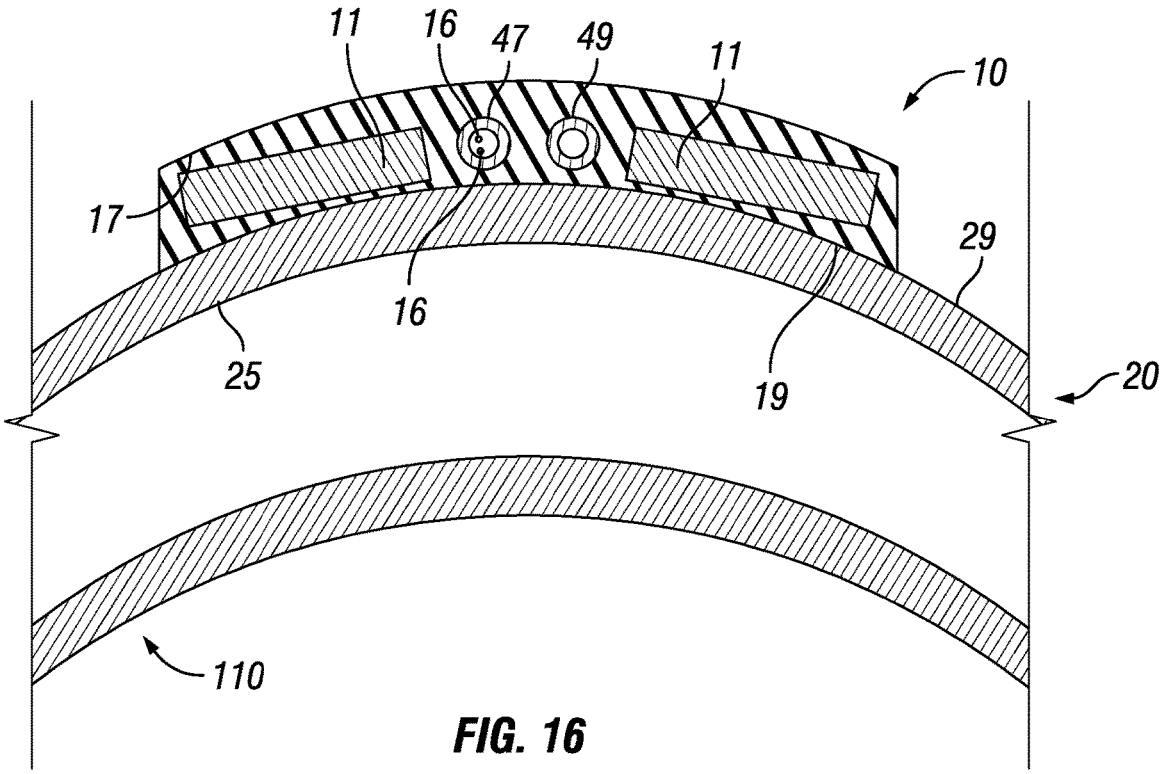
FIG. 16 shows a cross sectional view of an embodiment of a fiber optic cable system placed on the outside of multiple tubulars.

The high EM contrast materials of the present disclosure allow to locate tools or cable in between or on the outside of two or more tubulars. For instance, a cable 10 may be provided with a preselected mass 11 of high EM contrast material. Said cable can be arranged in between multiple tubulars (FIG. 15) or on the outside of multiple tubulars (FIG. 16). Herein, tubular 20 may be enclosed by a second tubular 100 (FIG. 15). Alternatively or in addition, tubular 20 may enclose a third tubular 110 (FIG. 16). Using high EM contrast material according to the present disclosure, within the ranges as indicated (for instance with respect to EM contrast, relative magnetism, and/or EIm), allows to detect the tools or cables even in between or on the outside of multiple casing layers. In accordance with the disclosure, using the high EM contrast allows to obtain an improved signal, allowing to detect the signal with respect to the background of the tubular metal, allowing accurate detection and location of tools or cables.

Figure 17:
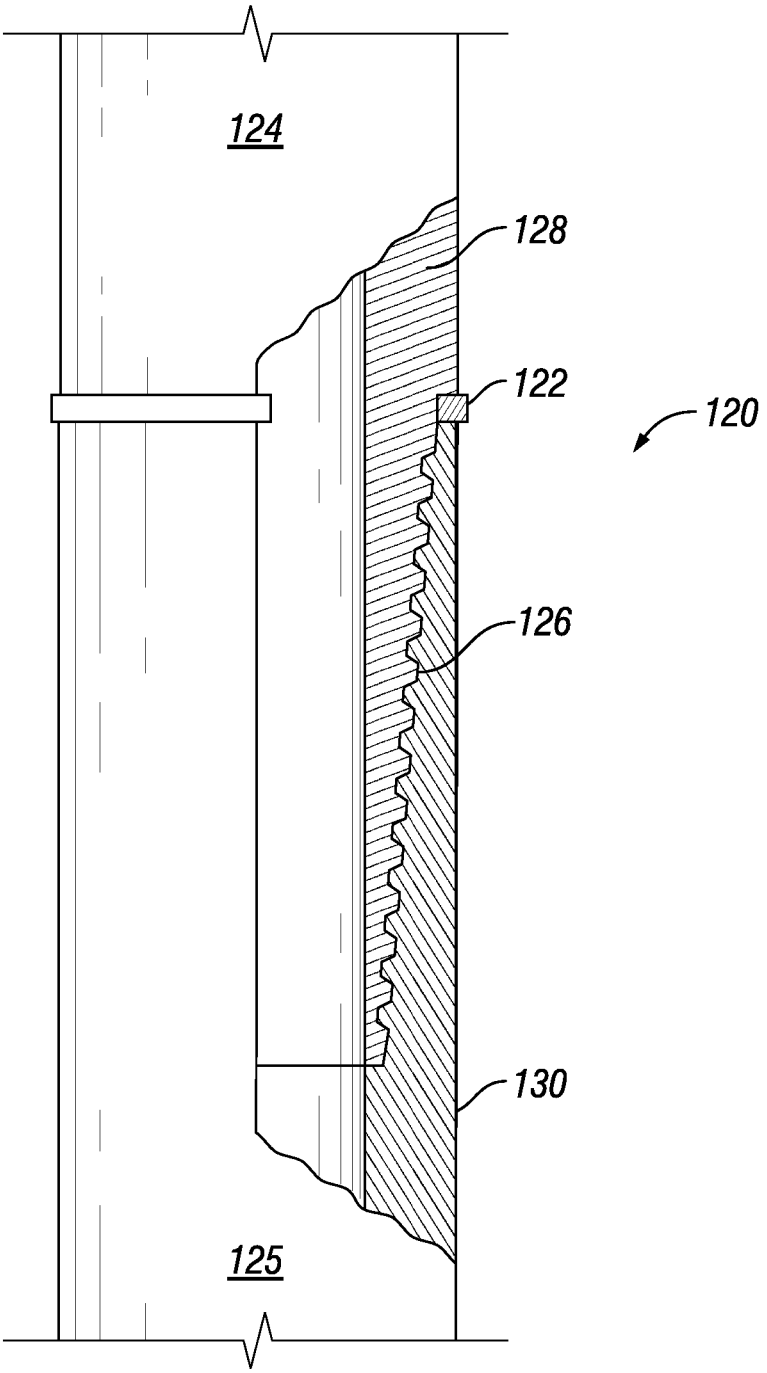
FIG. 17 shows a partially cut-out view of a tubing connection comprising a marker as an exemplary embodiment.

The high EM contrast materials of the present disclosure can be used to provide enhanced electromagnetic contrast and thereby allow to locate other downhole components. The concept of adding EM contrast can for instance be applied to:

- Locate downhole jewelry, such as for example: Sucker rod guides (as in U.S. Pat. Nos. 4,858,688, 5,115,863), centralizers (as in U.S. Pat. Nos. 4,938,299, 5,095,981, 5,247,990, 5,575,333, 6,006,830), cable blast protectors for plug and perforate operations (for instance manufactured by Cannon and Gulf Coast Downhole Technologies (GCDT)), mid-joint and cross-coupling clamps (for instance manufactured by Cannon and GCDT), band and band buckles, packers, sliding sleeve valves, gas lift valve, injection control devices, etc.;
- Create downhole wellbore markers that can serve the function of downhole jewelry, e.g., sucker rod guide, centralizers, cable blast protectors, mid-joint and cross-coupling clamps, bands and buckles;
- Downhole markers for depth determination. Herein, markers of high EM contrast materials are arranged at regular intervals along a wellbore. The markers can be detected by a detection tool. This enables improved depth determination by cumulative counting of respective intervals. Thus, the markers can also be used for tagging wellbores for accurate depth location. The markers can be arranged at any particular location, or be arranged at regularly spaced intervals along the wellbore;
- Create markers for joints 120. In particular flush and semi-flush joints 120 of tubing or casing (as shown in FIG. 17) may benefit from markers 122 made of, or comprising a suitable mass of, high EM contrast material according to the present disclosure. Herein, a first pipe section 124 is joined to a subsequent second pipe section 126 by, typically, a threaded coupling 128. The threaded coupling typically comprises a pin section 130 at the end of one of the pipe sections, for instance the first pipe section 124, and a box section at the end of the other pipe section. The marker 122 can be, for instance, a ring or strip. The markers can be arranged at the end of the box section 130 between the onset of the pin section 128 and the end of the box section, as shown in FIG. 17. However, the marker 122 may be arranged at any suitable location at or near the threaded section 126, or along each pipe section. To allow determination of cumulative depth, the markers are preferably arranged at regular intervals.

The markers 122 can provide sufficient EM contrast so the joint 120 can be located, for instance by casing collar logs (CCL). In the absence of markers, CCLs are otherwise rendered ineffective in the case of semi-flush and flush joint pipes due to lack of steel.

The markers 122 can be made of a high EM contrast material which is selected to suit the metal of each pipe section 124, 126, to prevent or at least limit galvanic corrosion.

Figure 18:
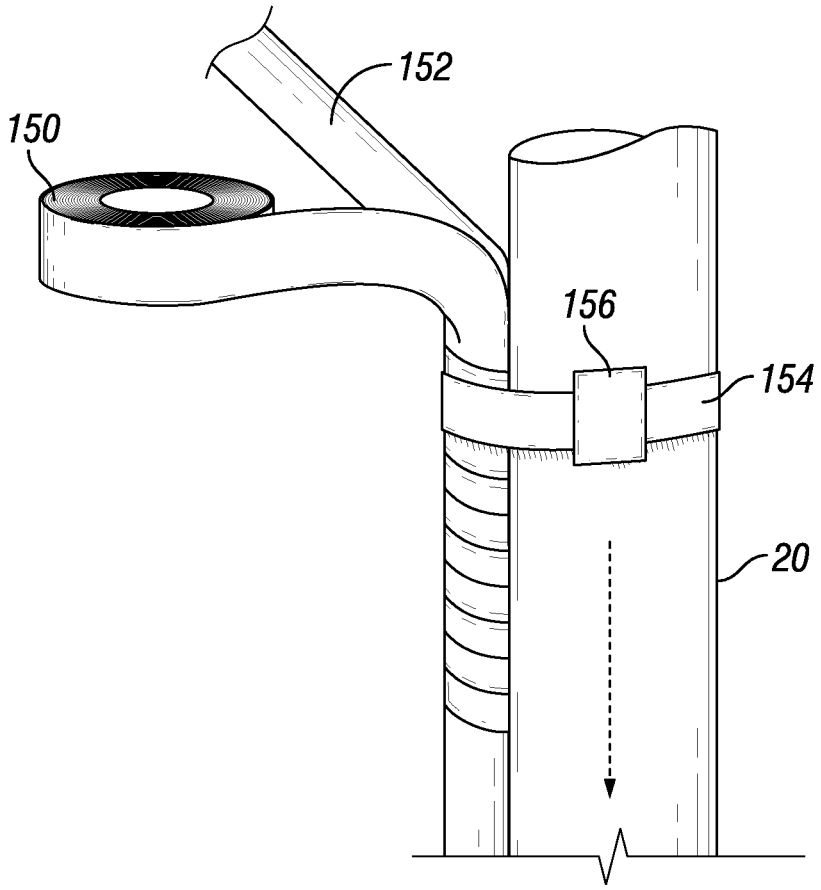
FIG. 18 shows a perspective view of another embodiment for locating a device using high EM contrast material in form of a tape.

In an embodiment, the EM contrast material can be manufactured in the form of a tape 150. For example, commercially available Mu-Metal foil (MuMETAL® Foil) can be made into a self-sticking tape. The tape 150 can facilitate application for locating various components as mentioned for instance below. FIG. 18 shows a method of applying the tape 150 to a control line 152 being banded to the casing 20. One or more bands 154 and corresponding clamps 156 may be used to connect the control line to the tubular 20. The tape 150 may be wound around at least part of the control line, for instance at or near a region of interest. The tape 150 may comprise one or more layers of the high EM contrast material as described above, see Table 3. The tape may for instance comprise one or more layers of mu-metal. The tape may be wrapped around the control line as it is banded on the casing and run in hole.

The high magnetic permeability material, such as the high EM contrast material, may also be employed in a system and method for communicating across a metal wall. Wall herein may refer to, for instance, the wall of a steel tubular in a wellbore, such as casing. Suitably, the high magnetic permeability material is applied in a core of an electromagnetic coil, in order to enhance inductivity.

Examples of alternative applications of the high EM contrast material of the disclosure may relate to power transfer, signal transfer and communications as described below:

- Applications of the high EM contrast material of the disclosure may improve power transfer thereby charging passive or rechargeable battery-powered devices fixed on the well tubulars. For example, a battery-powered cable orienting beacon may be strapped on the outside of casing to detect cable orientation as described in pre-grant publication US2017/082766A1. It is feasible that with the high EM contrast material there will be enough selectivity to charge the beacon with an in-well charging tool (such as disclosed in, for instance, US2017/107795A1).
- Applications of the high EM contrast material of the present disclosure may improve signal transfer thereby making it possible to actuate a switch across the metal wall. For example, in some applications a pressure monitoring gauge has been run on tubing or casing in conjunction with an externally mounted, outward facing perforating gun such that when the gun is fired it connects a perforation tunnel through the gun carrier to an electronic pressure gauge for permanent monitoring of individual and isolated formation pressure. The problem with these systems is that the gun firing head is pressure activated with internal tubing pressure and if the seals on the actuating piston fail there is a leak path from formation pressure to the inside of tubing. It is feasible that the improved EM contrast in the wellbore will enable switching of the firing head, thereby eliminating the need for a pressure port and potential leak path in the tubing.
- Applications of the high EM contrast material of the disclosure may improve communication thereby making it possible to actuate and communicate with passive sensors placed behind pipe including, for example, Pressure gauges, Temperature sensors, Resistivity Sensors.

In this disclosure we take an alternative approach to customizing communication and/or power-transfer to and through wellbore components—e.g. casing, clamps, hands, centralizers, screens, control-lines, dual-strings, flatpacks, thermocouples, etc. by intentionally constructing in-well electromagnetic contrast. The electromagnetic contrast is achieved by carefully selecting materials of different magnetic susceptibility and electrical conductivity.

The benefits of creating electromagnetic contrast has been demonstrated by altering the material selection in Applicant's Low Profile Cable (LPC) and accurately detecting it on large diameter casing with the DC-MOT (Magnetic Orientation Tool) from Hunting Energy Services Inc. (Texas, US). The normal LPC cable, which does not employ any high permeability material, requires extensive mapping with the MOT tool in order to build confidence; the wireline run tool is stopped several times per joint of pipe for several pipe joints to locate the cable and build a cable location map. The improved LPC according to the present disclosure greatly improves accuracy, eliminates uncertainty in detection and—in practice—allows 'point and shoot' operation. I.e. the locating tool is able to accurately locate the cable with high confidence at every stop. Creating more electromagnetic contrast using the materials of the present disclosure in sub-surface completion allows to improve the resolution of other similar tools, such as the Wireline Perforating Platform (WPP) by Schlumberger Ltd. or the Metal Anomaly Tool (MAT) by Guardian Global Technologies Ltd. (offered, for instance, by Halliburton).

In addition to 'point and shoot' operation, the accuracy of the detection using the system and method of the present disclosure enables to increase the perforation phasing. Le, the perforations do not need to be 0-phased (i.e. directed in substantially linear direction), but instead can be fired to cover a radial angle (with respect to the radial direction of the casing, i.e. in a plane perpendicular to the longitudinal axis of the casing). Due to the accuracy of the location detection according to the present disclosure, the radial angle may be, for instance, up to about 180° or even up to about 270°.

The present disclosure allows to locate tools and cable downhole on the outside of a metal tubular with high accuracy even in worst case scenarios (such as when relatively thin metal mass is located at the thin wall side of a casing). Within the thresholds and ranges as described herein, the accuracy can be within a 5 degree, or even 1 degree (radially) error margin.

In the disclosure, including improved cable, an equivalent inductive mass (EIm) may be computed, defined as:

$$\text{Equivalent Inductive mass (EIm)} = \text{mass} \cdot \mu_r \cdot \sigma$$

Herein, $\mu_r$ is relative magnetic permeability and a is electrical conductivity (also known as "specific conductance") of the selected material. EIm is an indication of the amount of energy induced and dissipated in the metal. While mass (m) is a direct measure of the amount of material (for instance along a unit of length, and/or at a selected location), the relative permeability indicates the ability of the material to concentrate magnetic flux lines through it, and conductivity refers to the ease of current flow in the material. Henceforth, EIm can be used to select a suitable material and amount thereof, for various wellbore components and to optimize the electromagnetic contrast in the wellbore.

The electromagnetic contrast can be expressed in signal to background ratio. Signal to background ratio may be defined as:

$$(\mathrm{EIm})_{device}/(\mathrm{EIm})_{background}=(\mathrm{mass}\cdot\mu_r\cdot\sigma)_{device}/(\mathrm{mass}\cdot\mu_r\cdot\sigma)_{background}$$

Herein, the mass of device and background are taken over the width of the device or its reinforcement strip. If the device is arranged with respect to a tubular, both the mass for the device and for the background are determined with respect to an azimuthal section, along the azimuthal angle covered by the device.

It is considered that, taking the case of oriented perforating and to locate a device such as tools or cable as example, a magnetic-permeability element (for the arranging with the device to be detected) which offers a ratio of target-to-background of between zero and 5 may work with low or too low of an accuracy. A ratio of target-to-background signal in the range of from 5 to 10 may have sufficient accuracy to work acceptably, but may have moderate accuracy (acceptable accuracy) which would still require a relatively large safety margin to be respected for locating the perforations. A ratio of target-to-background signal of 10 and above, or more preferably 15 and above, will result in very accurate detection (as described above, wherein accuracy has an error margin of less than 5 degrees radially, or even less than 1 degree radially) with electromagnetic detection tools as currently available on the market. The latter accuracy can even be obtained in a worst case scenario when the device is arranged at or near a thin wall side of a casing.

The use of the magnetic-permeability element for downhole applications provided surprisingly good results. As the metal wall of casing will act as a Faraday cage, the use of specific high relative magnetic permeability material was expected to only have a secondary effect. In addition, the high relative magnetic permeability materials typically have high permeability but typically low electrical conductivity. In practice however, as indicated for instance in the examples below, results were very good and allowed to accurately locate devices and optical cable. Even in a worst case scenario wherein the cable was arranged at the thin wall side of a relatively thick casing, the cable could be detected virtually without a radial error (error smaller than 1 degree radially).

The present disclosure is not limited to the embodiments as described above and the appended claims. Many modifications are conceivable and features of respective embodiments may be combined.

The following examples of certain aspects of some embodiments are given to facilitate a better understanding of the present invention. In no way should these examples be read to limit, or define, the scope of the invention.

EXAMPLES

In a first test, an improved Low Profile Cable (exemplified in FIG. 2 or 5) with relatively narrow Amumetal bars (mu-metal; having $\mu_r$=80,000) bars (0.125" height×0.25" width [3.2 mm×6.4 mm]) was tested. The signal strength using a DC-MOT tool (Hunting) significantly improved. With respect to a cable provided with metal or steel bars (e.g. a material listed in Table 1) represented at least twice the amplitude and was at least twice as often properly detected (measured in counts). Also, the cable was accurately located at its correct azimuthal position, virtually within +/−5° (radially) of its actual position.

In a second test, wider strips of Amumetal bars (0.125"× 0.5" width [3.2 mm×12.7 mm]) were used, and an increase in the signal strength was noted. The error margin (within +/−5° (radially) of its actual position) was similar. Yet, the MOT tool could locate the cable faster, requiring fewer measurements.

The LPC cable provided with regular steel reinforcement is not designed to boost the electromagnetic contrast with respect to the casing, and therefore the signal to background ratios presented in Table 2 were simple ratios of respective mass.

Table 4 shows—as an example—the low accuracy of the detection when Cable 1—conventional cable—lands on the thin wall side of a wellbore tubular. The detection tool in this case finds the cable, but with a relatively high error margin, for instance 78 degrees off from its true location. An example of high accuracy detection using cable provided with high EM contrast material according to the present disclosure is also shown in Table 4, as seen when detecting Cable 2, which is also arranged on the thin wall side of the wellbore tubular. The detection tool in this case finds the cable in its true location. I.e. the cable provided with high EM contrast material according to the present disclosure allows to reduce the error margin to below 5 degrees, or even to below 1 degree (radially).

TABLE 4

Test configuration: Cable arranged diametrically opposite the heavy-wall side of a tubular
Scale: Total Metal Mass: about 2000-8000 Counts
True cable placement angle = 68 degree

| | High Count | Low Count | Total Counts | Reported Angle | Error |
|---|---|---|---|---|---|
| Cable 1: Narrow LPC | 3549 | 3367 | 182 | 350 | −78 |
| Cable 2: 0.25" Mu-Metal | 4816 | 2385 | 2431 | 68 | 0 |

Figure 19:
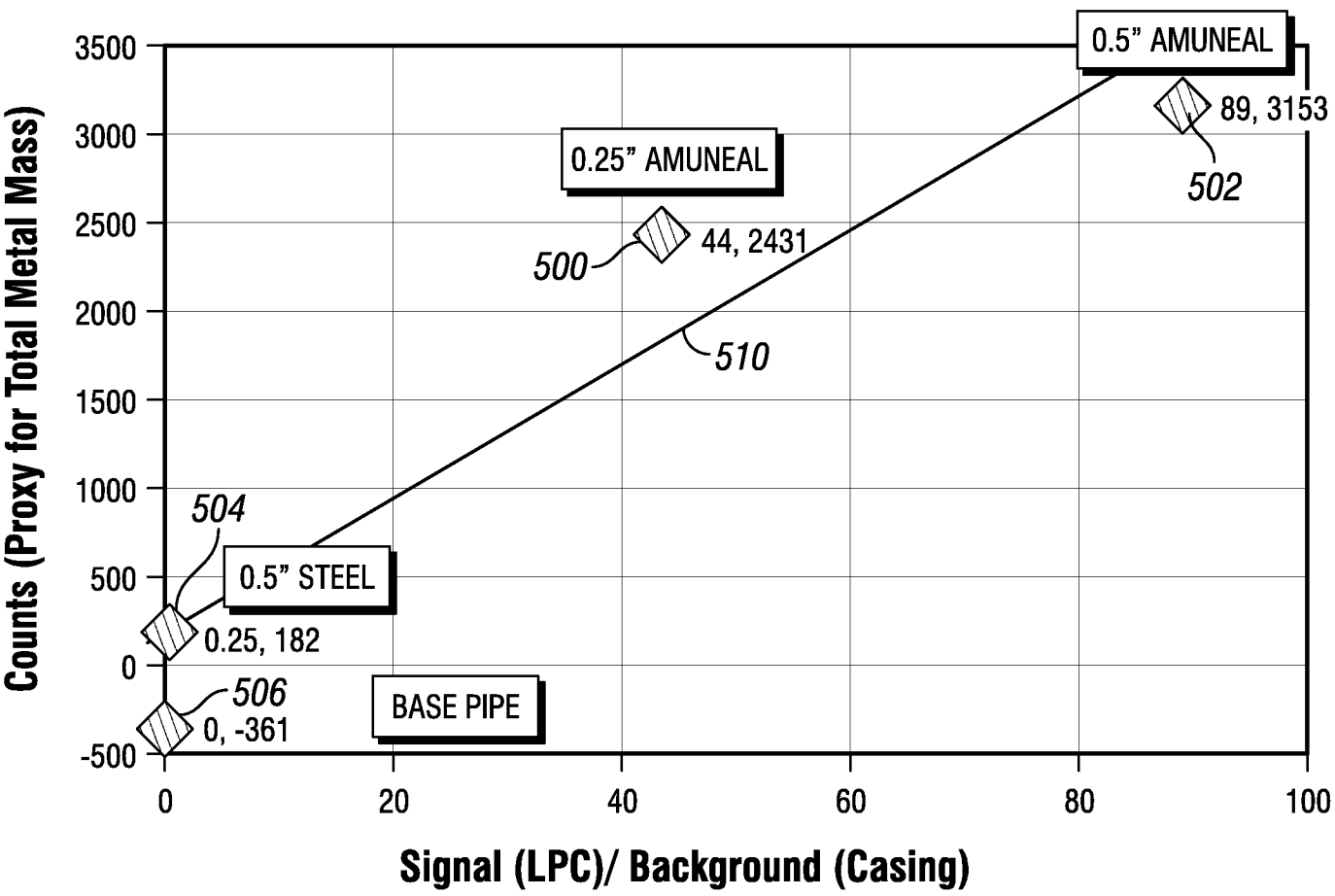
FIG. 19 shows an exemplary diagram indicating signal strength with respect to background signals (horizontal axis) versus a number of detection hits (vertical axis) for various optical cable systems.

FIG. 19 shows how the counts on the DC-MOT increase with increasing Target-to-background ratio. For the improved LPC Cable with mumetal strips 11 having a width of about 0.25" (entry 500) or 0.5" (entry 502), the ratio of target and background (based on ratios of respective EIm values for device to be detected and background (such as casing) over de width of the device, such as cable) is 44 and 89, respectively. This is significantly higher than 0.25 (entry 504) for a conventional cable provided with regular steel reinforcement bars. As mentioned, the wall of a typical oilfield tubular according to API specifications may have a tolerance in wall thickness of up to −12.5%, potentially leading to counts and a (false positive) detection signal of the heavy wall side as well (entry 506 in FIG. 19).

The diagram of FIG. 19 can be used to design an application specific cable, for instance based on trend line 510. In a practical embodiment, the ratio of target-to-background signal (based on ratios of respective EIm values for device to be detected versus the background over the width of the device, or over the azimuthal angle covered by the device if it is arranged with respect to a tubular) indicates the accuracy to be expected.

A cheaper alternative to mumetal with similar characteristics—Electrical grade steel—was also tested. The cable 10 in FIG. 8 was assembled with Electrical Steel bars (0.125"× 0.5"), and accurately located (error below 5 degrees off radially in a worst case scenario). While the electrical steel has lower EM contrast than mu-metal, the performance, in terms of recorded counts, on the DC-MOT was the same.

The accuracy could be tuned above a threshold, similar to mumetal, using sufficient number of laminae. For instance, an electrical steel bar assembled using about 9 laminae provided similar results as a cable comprise about two laminae made of mumetal.

Essentially due to skin effect, the DC-MOT is only interrogating small thickness of the bulk material. The skin depth (δ) of interrogation is calculated as:

$$\delta=1/\sqrt{\pi f\sigma\mu_r}$$

wherein f is the frequency of EM radiation, $\mu_r$ is relative magnetic permeability and σ is electrical conductivity.

For instance, at 60 Hz, the skin depth for mumetal (for instance as provided by Amumetal Manufacturing Corp. [US]) and electrical steel is about 0.006" and 0.018", respectively. While for Amumetal the skin depth may be much smaller than the laminae thickness—0.06"—it may be approximately the same as the laminae thickness in the case of electrical steel. If the laminae were perfectly insulated, the cable with electrical steel would have resulted in better response than a cable provided with a laminated mumetal layer.

While the above may refer to specific examples of hydraulic, electrical, or fiber optic cables, it will be clear to the skilled person that these cable types are interchangeable within the context of including the high magnetic permeability material. The cable may also take the form of a combined cable, which may comprise any combination of multiple types of lines, such as, for example, electric and fiber optic lines, or hydraulic and fiber optic lines.

The person skilled in the art will understand that the present invention can be carried out in many various ways without departing from the scope of the appended claims.

Summarizing various aspects and embodiments, the present disclosure further descibes a system for providing information through a metal wall, the system comprising a device adapted to be arranged on one side of the metal wall; and a magnetic-permeability element, provided at, near or connected to the device, comprising a material having a relative magnetic permeability $\mu_r$ of at least 2000. The material may have an EM contrast ratio of 20 $\mu\Omega^{-1}\cdot cm^{-1}$ and above, wherein EM contrast is defined as $\mu_r/\rho$. The material may have an EM contrast ratio of at least 50 $\mu\Omega^{-1}\cdot cm^{-1}$. The metal wall may be the wall of a wellbore tubular. The device may be a cable, such as a fiber optic cable. The material may have a relative magnetic permeability of at least 8,000, preferably of at least 20,000; and/or a resistivity of at least 30 μΩ·cm, preferably of at least 37 μΩ·cm. The material may be selected from the group of: mu-metal, permalloy, and non-oriented electrical steel.

The present disclosure further descibes a use of such a system for providing information through a metal wall. The use may comprise arranging a device on one side of the metal wall; and arranging a magnetic-permeability element at, near or connected to the device, the magnetic-permeability element comprising a material having a relative magnetic permeability $\mu_r$ of at least 2000. The use may further comprise activating a magnetic orienting tool on an opposite side of the metal wall to locate the magnetic-permeability element on said one side of the metal wall. The magnetic-permeability element may be optimized using equivalent inductive mass (EIm), EIm being defined as mass·$\mu_r$·σ. A target-to-background EIm ratio may be selected to exceed 5. The magnetic-permeability element be by optimized, wherein the target-to-background ratio is selected to exceed 15.

It is finally summarized, that the magnetic permeability material as desribed herein may also be employed to inductively couple the device to a power supply. This allows the power supply and the device to be separated by a metal wall. This may be combined with a rechargeable battery within the device which can be inductively charged. This may be employed, for example, to power sensors comprised in the device.

That which is claimed is:

1. A method of perforating a wellbore tubular, comprising:

providing a cable system for downhole use, comprising a fiber-optic cable and a magnetic-permeability element configured along a length of the fiber-optic cable, wherein said magnetic-permeability element comprises a material having a relative magnetic permeability $\mu_{r,m}$ of at least 2,000, selected from a group consisting of: mu-metal, Amumetal, permalloy, supermalloy, electrical steel, sendust, and other materials having similar magnetic properties to mu-metal;

providing the wellbore tubular downhole, said wellbore tubular comprising a metal wellbore tubular wall, wherein the cable system is arranged on an outside of said wellbore tubular;

lowering a magnetic orienting tool into the wellbore tubular;

locating the cable system by sensing the magnetic-permeability element through the metal wellbore tubular wall with the magnetic orienting tool;

subsequently perforating the metal wellbore tubular wall away from the cable system.

2. The method of claim 1, wherein the cable is a fiber-optic cable comprising a fiber optic line.

3. The method of claim 2, wherein the magnetic-permeability element and the fiber optic line are encapsulated together within an encapsulation.

4. The method of claim 1, wherein said relative magnetic permeability $\mu_{r,m}$ of at least 2,000 exceeds a relative magnetic permeability $\mu_{r,w}$ of said metal wellbore tubular wall.

5. The method of claim 4, wherein an EM contrast ratio of the material exceeds an EM contrast ratio of said metal wellbore tubular wall, wherein said EM contrast ratio of the material is defined as $\mu_{r,m}\cdot\sigma_m$, and wherein said EM contrast ratio of the metal wellbore tubular wall is defined as $\mu_{r,w}\cdot\sigma_m$, wherein $\sigma_m$, is an electrical conductivity of the material and $\sigma_w$ is an electrical conductivity of the metal wellbore tubular wall.

6. The method of claim 1, wherein the material comprises electrical steel.

7. The method of claim 6, wherein the electrical steel is selected from the group consisting of lamination steel, silicon electrical steel, silicon steel, relay steel, and transformer steel.

8. The method of claim 6, wherein the electrical steel is an iron alloy comprising silicon.

9. The method of claim 6, wherein the electrical steel is an iron alloy comprising up to 6.5% of silicon by volume.

10. A method of perforating a wellbore tubular, comprising:

providing a cable system for downhole use, comprising a fiber-optic cable and a magnetic-permeability element configured along a length of the fiber-optic cable, wherein said magnetic-permeability element comprises a material having a relative magnetic permeability $\mu_{r,m}$ of at least 8,000;

providing the wellbore tubular downhole, said wellbore tubular comprising a metal wellbore tubular wall, wherein the cable system is arranged on an outside of said wellbore tubular;

lowering a magnetic orienting tool into the wellbore tubular;

locating the cable system by sensing the magnetic-permeability element through the metal wellbore tubular wall with the magnetic orienting tool;

subsequently perforating the metal wellbore tubular wall away from the cable system.

11. The method of claim 10, wherein the cable is a fiber-optic cable comprising a fiber optic line.

12. The method of claim 11, wherein the magnetic-permeability element and the fiber optic line are encapsulated together within an encapsulation.

13. The method of claim 10, wherein said relative magnetic permeability $\mu_{r,m}$ of at least 8,000 exceeds a relative magnetic permeability $\mu_{r,w}$ of said metal wellbore tubular wall.

14. The method of claim 13, wherein an EM contrast ratio of the material exceeds an EM contrast ratio of said metal wellbore tubular wall, wherein said EM contrast ratio of the material is defined as $\mu_{r,m}\cdot\sigma_m$, and wherein said EM contrast ratio of the metal wellbore tubular wall is defined as $\mu_{r,w}\cdot\sigma_m$, wherein $\sigma_m$, is an electrical conductivity of the material and $\sigma_w$ is an electrical conductivity of the metal wellbore tubular wall.

15. A method of perforating a wellbore tubular, comprising:

providing a cable system for downhole use, comprising a fiber-optic cable and a magnetic-permeability element configured along a length of the fiber-optic cable, wherein said magnetic-permeability element comprises a material having a relative magnetic permeability of at least 2,000;

providing the wellbore tubular downhole, said wellbore tubular comprising a metal wellbore tubular wall, wherein the cable system is arranged on an outside of said wellbore tubular, and wherein an EM contrast ratio of the material exceeds an EM contrast ratio of said metal wellbore tubular wall, wherein said EM contrast ratio of the material is defined as $\mu_{r,m}\cdot\sigma_m$, and wherein said EM contrast ratio of the metal wellbore tubular wall is defined as $\mu_{r,w}\cdot\sigma_m$, wherein $\sigma_m$, is an electrical conductivity of the material and $\sigma_w$ is an electrical conductivity of the metal wellbore tubular wall;

lowering a magnetic orienting tool into the wellbore tubular;

locating the cable system by sensing the magnetic-permeability element through the metal wellbore tubular wall with the magnetic orienting tool, whereby the high EM contrast ratio of the material compared to that of the metal wellbore tubular wall allows to improve the signal sensed by the magnetic orienting tool with respect to the background of the tubular metal, thereby allowing accurate detection and location of the cable system;

subsequently perforating the metal wellbore tubular wall away from the cable system.

16. The method of claim 15, wherein said relative magnetic permeability $\mu_{r,m}$ of at least 2,000 exceeds a relative magnetic permeability $\mu_{r,w}$ of said metal wellbore tubular wall.

17. The method of claim 15, wherein the cable is a fiber-optic cable comprising a fiber optic line.

18. The method of claim 17, wherein the magnetic-permeability element and the fiber optic line are encapsulated together within an encapsulation.

* * * * *